US010204480B2

(12) United States Patent
Hosokawa

(10) Patent No.: US 10,204,480 B2
(45) Date of Patent: Feb. 12, 2019

(54) GAMING MACHINE AND GAMING SYSTEM

(75) Inventor: Norio Hosokawa, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 998 days.

(21) Appl. No.: 12/057,962

(22) Filed: Mar. 28, 2008

(65) Prior Publication Data

US 2008/0248877 A1 Oct. 9, 2008

(30) Foreign Application Priority Data

Apr. 3, 2007 (JP) ..... 2007-097746

(51) Int. Cl.
*G07F 17/32* (2006.01)

(52) U.S. Cl.
CPC ..... *G07F 17/323* (2013.01); *G07F 17/32* (2013.01); *G07F 17/3227* (2013.01); *G07F 17/3267* (2013.01)

(58) Field of Classification Search
USPC ..... 463/42
See application file for complete search history.

(56) References Cited

U.S. PATENT DOCUMENTS 5,720,663 A * 2/1998 Nakatani ..... A63F 13/005 463/23
6,984,174 B2 * 1/2006 Cannon et al. ..... 463/25
2002/0177483 A1 * 11/2002 Cannon ..... 463/42
2002/0183045 A1 * 12/2002 Emmerson ..... H04L 63/08 455/412.1
2003/0008708 A1 * 1/2003 Suchocki ..... A63F 13/10 463/29
2003/0022713 A1 * 1/2003 Jasper ..... G07F 17/3267 463/20
2003/0064771 A1 * 4/2003 Morrow ..... G07F 17/32 463/16
2004/0014525 A1 * 1/2004 Suganuma ..... A63F 13/02 463/30
2004/0166918 A1 * 8/2004 Walker et al. ..... 463/16
2004/0166940 A1 * 8/2004 Rothschild ..... G07F 17/3234 463/42
2004/0198496 A1 * 10/2004 Gatto ..... A63F 13/12 463/42
2005/0079911 A1 * 4/2005 Nakatsu ..... 463/26
2005/0282607 A1 * 12/2005 Gauselmann ..... G07F 17/32 463/16

(Continued)

FOREIGN PATENT DOCUMENTS

JP 2001-087452 4/2001
JP 2007054157 A * 3/2007

*Primary Examiner* — Tramar Harper
(74) *Attorney, Agent, or Firm* — Lex IP Meister, PLLC

(57) ABSTRACT

A gaming environment, in which a new gaming machine and gaming system in which entertainment aspect of the game may be enhanced, is described. Especially a gaming environment, in which a slot game (the first game) corresponding to a first game program 33*a* in the RAM 33 is progressed by the main CPU 32 of the slot machine 210 in the gaming system 220, when the payout rate of the slot machine 210 is greater or equal to a predetermined value, a second game program which is different from the first game program 33*a* is downloaded from the game server 200 by the communication process unit 211 of the slot machine 210, the second game is progressed by the main CPU 32 via executing the second game program, is described.

8 Claims, 11 Drawing Sheets

(56) References Cited

U.S. PATENT DOCUMENTS

| | | | | |
|---|---|---|---|---|
| 2006/0009280 | A1* | 1/2006 | Joshi | G07F 17/32 463/25 |
| 2006/0046820 | A1* | 3/2006 | Inamura | G07F 17/32 463/16 |
| 2007/0219000 | A1* | 9/2007 | Aida | G07F 17/32 463/42 |
| 2007/0225065 | A1* | 9/2007 | Wright | G07F 17/32 463/25 |
| 2008/0070699 | A1* | 3/2008 | Park | G07F 17/32 463/42 |
| 2008/0076574 | A1* | 3/2008 | Okada | G07F 17/32 463/42 |
| 2008/0081699 | A1* | 4/2008 | Haeuser | A63F 13/12 463/42 |
| 2008/0090654 | A1* | 4/2008 | Okada | G07F 17/32 463/29 |
| 2010/0075746 | A1* | 3/2010 | Anderson | G07F 17/323 463/25 |

* cited by examiner

FIG. 3

| | FIRST REEL | SECOND REEL | THIRD REEL |
|---|---|---|---|
| CODE NUMBER DATA | SYMBOL ARRAY | SYMBOL ARRAY | SYMBOL ARRAY |
| 1 | 7 | 7 | 7 |
| 2 | | | 7 |
| 3 | | | |
| 4 | | | |
| 5 | | | |
| 6 | | | |
| 7 | | | |
| 8 | 7 | | |
| 9 | | 7 | |
| 10 | | | 7 |
| 11 | | | |
| 12 | | | |
| 13 | | | |
| 14 | | BAR | BAR |
| 15 | | | |
| 16 | BAR | | |
| 17 | | | |
| 18 | | | |
| 19 | | | |
| 20 | | | |

FIG. 5

92

WINNING COMBINATION DETERMINATION TABLE

| 92a SYMBOL COMBINATION | | | 92b NUMBER OF COINS PAIDOUT BET NUMBER:1 | 92c WINNING COMBINATION |
|---|---|---|---|---|
| 7 | 7 | 7 | 30 | 7(BONUS GAME TRIGGER) |
| BAR | BAR | BAR | 30 | BAR |
| BELL | BELL | BELL | 10 | BELL |
| PLUM | PLUM | PLUM | 8 | PLUM |
| WATERMELON | WATERMELON | WATERMELON | 5 | WATERMELON |
| CHERRY | CHERRY | CHERRY | 5 | CHERRY |

GAMING MACHINE AND GAMING SYSTEM

CROSS-REFERENCE TO RELATED APPLICATIONS

This application is based upon and claims a priority from the prior Japanese Patent Application No. 2007-097746 filed on Apr. 3, 2007, the entire contents of which are incorporated herein by reference.

BACKGROUND

Field

The present invention relates to a gaming machine and a gaming system in which a game is provided.

Description of Related Art

Conventionally, the gaming machines in this area, for example, includes slot machines in which slot games are provided to the players. The slot games are the games in which the gaming media (medals and the like) are paid out corresponding to the symbol combination state of the symbols variably displayed on the display. Also, in additional to the above slot machines, the gaming machines in which trump games and sports games are provided, are also known as the gaming machines.

SUMMARY

In view of the foregoing, one or more aspects of the present invention relate to a gaming machine, a gaming method thereof, a gaming system, a computer readable medium having computer-executable instructions or the like that it is possible to provide a new gaming machine and gaming system, in which entertainment aspect of the game may be enhanced.

One or more of the above aspects of the invention is more fully described in the following detailed description when read in connection with the accompanying drawings. It is to be expressly understood, however, that the drawings are for purpose of illustration only and not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

FIG. 3 is an explanatory view showing the correspondence relation between symbol arrangement on the first reel to the third reel and code number data.

FIG. 5 is an explanatory view showing an example of a winning combination determination table.

DETAILED DESCRIPTION

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine based on one or more aspects of the invention is described in detail with reference to the drawings based on an embodiment embodying one or more aspects of the invention as a game system and gaming machine, a server, a gaming system. However, it is appreciated that one or more aspects of the present invention may be embodied in distributable (via CD and the like) or downloadable software games, console games, and the like. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU" and "processor" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

Hereinafter, the embodiment embodying the present invention is described in detail with reference to the drawings.

(Construction of a Gaming System)

Figure 1:
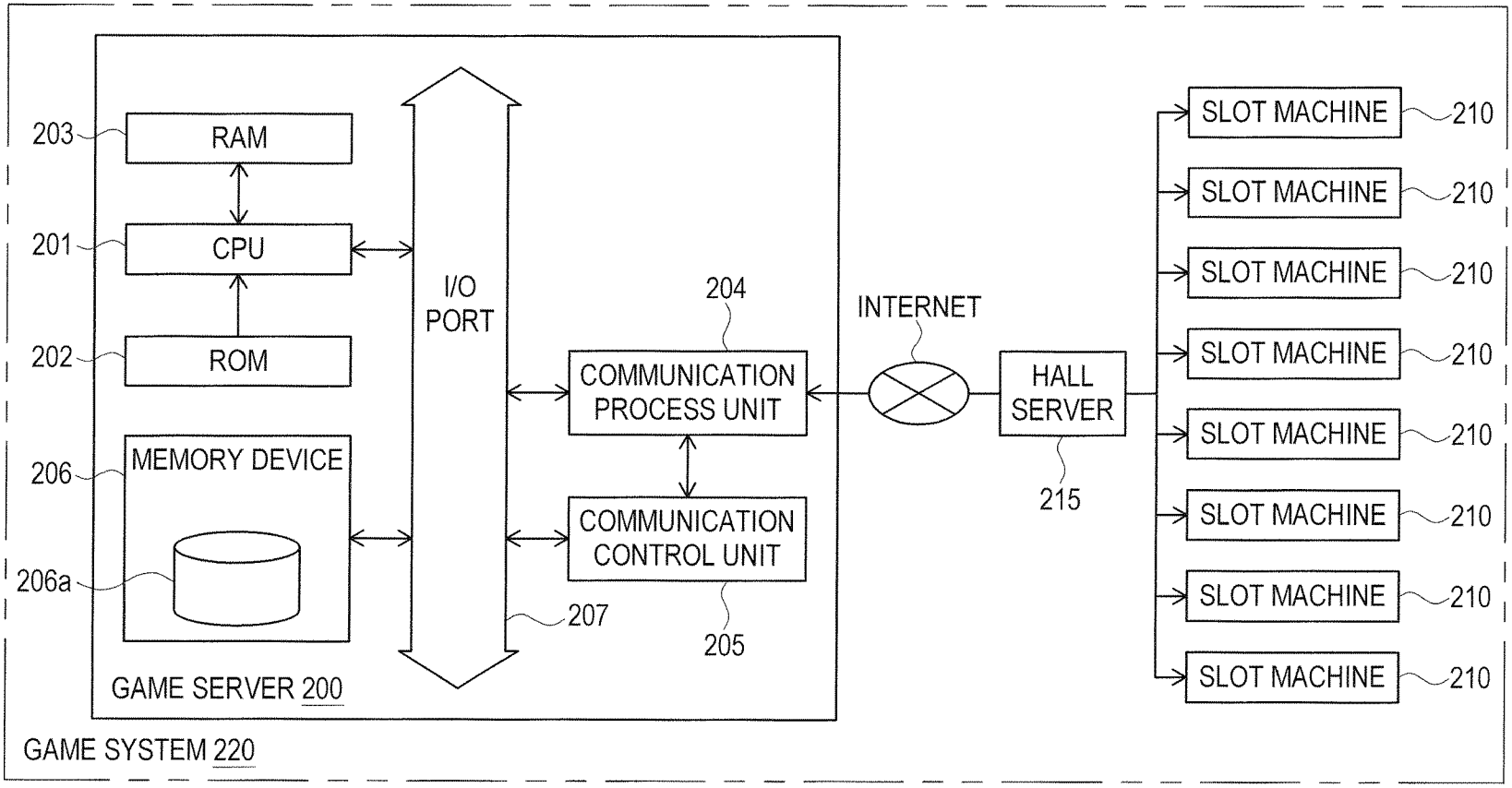
FIG. 1 is a block diagram schematically showing a gaming system according to the embodiment.

First, the construction of the gaming system 220 based on the present embodiment, will be explained with reference to FIG. 1. FIG. 1 is a block diagram showing the gaming system 220 according to the embodiment embodying the present invention. The gaming system 220 includes eight slot machines 210, a hall sever 215 which is connected with each slot machine 210, a game sever 200 which is connected with the hall server 215 by internet. The hall sever 215 may communicate with each slot machine 210 and the game sever 200.

The game sever 200 is the sever of the present invention, including a CPU 201, a ROM 202 and a RAM 203. Also the game sever 200 includes a communication process unit 204, a communication control unit 205 and a memory device 206. The communication process unit 204 is connected to the CPU 201 via an I/O port 207.

The CPU 201 is run based on the predetermined gaming system program. Signals are input and output to the other elements via the I/O port 207, and the performance control of the entirety game sever 200 is executed by the CPU 201. The programs such as BIOS executed by the CPU 201 and the perpetual data are stored in the ROM 202. The data and the programs used to operate the CPU 201 are stored in the RAM 203. At least, the gaming system program is stored in the RAM 203.

The communication process unit 204 is run based on the instruction of the CPU 201. The connection and the disconnection of the circuit which is used to communicate with the slot machine 210 is controlled by the communication process unit 204. The data transmission is executed by the communication process unit 204 based on the instruction of the communication control unit 205.

The second game program which may be executed by the slot machine 210 is stored in the memory device 206. When the second game program is executed by the slot machine 210, the second game corresponding to the second game program is started.

(Construction of the Slot Machine)

Figure 2:
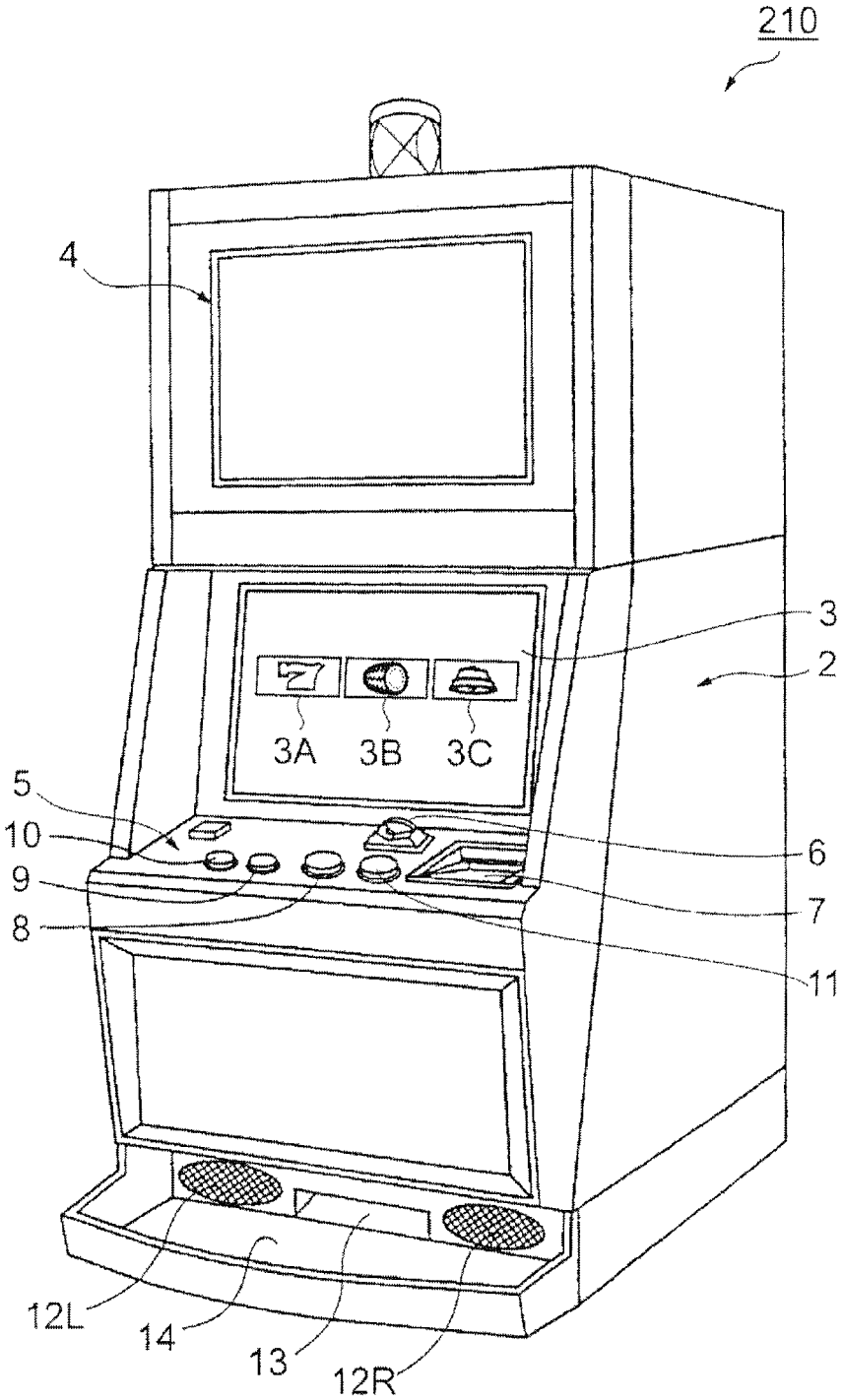
FIG. 2 is an perspective view showing an entirety construction of a slot machine according to the embodiment.

Next, the construction of the slot machine 210 in the above gaming system 220 is described with reference to FIG. 2. FIG. 2 is a perspective view showing an entirety construction of the slot machine 210. The slot machine 210 is constructed to execute the slot game using the scrolling images of plural symbols as the first game. Two game modes are included in the slot machine 210, a base game mode and a bonus game mode. In the base game mode, a slot game is executed under a condition that the betting operation is received from a player and coins are used in the game. In the bonus game mode, the slot game (hereinafter, referred as "free game") is executed automatically without receiving the betting operation from the player. In the slot machine 210, when a predetermined condition is satisfied in the slot game of the base game mode, the game mode changes to a bonus game mode, and the free game is executed.

The slot machine 210 includes a cabinet 2 which contains the electronic or the mechanic devices used to execute the above slot game. At the front of the cabinet 2, a main display 3 constructed from LCD (Liquid Crystal Display) is arranged. Also, above the main display 3, a sub-display 4 constructed from LCD is arranged.

As shown in FIG. 2, in the middle of the screen of the main display 3, three symbol display areas 3A, 3B and 3C are arranged in line on the crosswise direction. On the three symbol display areas 3A, 3B and 3C, either in the base game mode or in the bonus game mode, the scrolling images in which plural kinds of symbols are moving from up to down (reel images displayed as the mechanic reels are rotating) are displayed.

The symbols displayed on the three symbol display areas 3A, 3B and 3C are shown in the symbol arrangement table in FIG. 3.

On the left symbol display area 3A, the symbols displayed on the symbol array of the first reel are scrolled and displayed from the top repeatedly. After the symbol display area 3A is scrolled and displayed, one symbol of the symbol array on the first reel is stopped and displayed on the symbol display area 3A.

In the same way, on the middle symbol display area 3B, the symbols displayed on the symbol array of the second reel are scrolled and displayed from the top repeatedly. On the middle symbol display area 3C, the symbols displayed on the symbol array of the third reel are scrolled and displayed from the top repeatedly. After the scrolling and displaying, one symbol of the symbol array is stopped and displayed on each symbol display area.

On the sub-display 4, the images related to the payout table, the explanation of the game and the like (for example, the explanation of the game content) are displayed.

In the slot machine 210, under the main display 3, a base portion 5 which is almost horizontal is arranged. In the base portion 5, a coin insertion slot 6, a bill insertion portion 7, a spin switch 8, a 1-BET switch 9, a max-BET switch 10 and a cash-out switch 11 are arranged.

The coin insertion slot 6 is arranged to insert coins betted by the player to the game. The coin insertion slot 6 includes a coin sensor 6*a* to output signals for showing coin insertion. The bill insertion portion 7 is arranged for the player to insert bills. The bill insertion portion 7 includes a bill insertion sensor 7*a* to output the signals for bill insertion.

The spin switch 8 is arranged for a player to execute the operation to start a slot game by displaying the scrolling images of symbols. 1-Bet switch 9 is arranged to bet one coin for one bet operation. The max-bet switch 10 is arranged to bet a maximum of coins which may be betted in one game for one bet operation. The cash-out switch 11 is an operation button to payout the credited coins to a coin receiving portion 14.

Furthermore, at the bottom part of the cabinet 2 in the slot machine 210, a coin payout opening 13 and a coin receiving portion 14 to receive the paid out coins, are arranged. Also, on the either side across the coin payout opening 13 from, either of a speaker 12L and 12R is arranged respectively.

Figure 4:
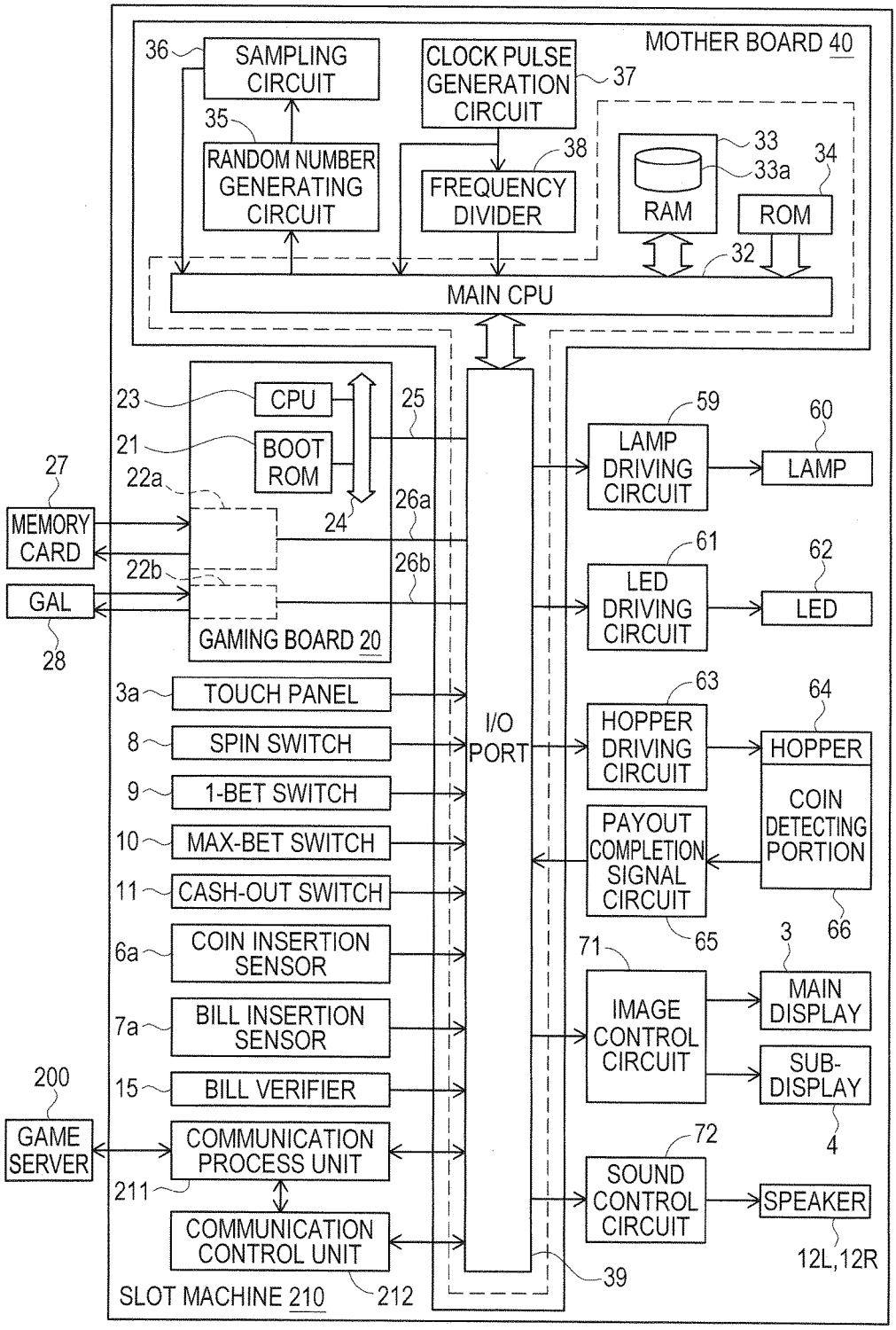
FIG. 4 is a block diagram showing an internal construction and peripheral devices of the slot machine according to the embodiment.

FIG. 4 is a block diagram showing an internal construction of the slot machine and the peripheral devices according to the embodiment. The slot machine 210 includes plural construction elements which are centered around a gaming board 20 and a mother board 40.

The gaming board 20 includes a CPU 23, a boot ROM 21, card slots 22*a* and 22*b*. The CPU 23 is connected with the boot ROM 21 by the internal bus 24. Each of the card slots 22*a* and 22*b* is corresponding to a memory card 27 and a GAL 28 respectively. The gaming board 20 is a device used to import the after-mentioned game programs to the mother board 40 from the memory card 27. The gaming board 20 is a device used to import the payout rate setting data from the GAL 28.

The CPU 23 and the boot ROM 21 are connected to the mother board 40 by the PCI bus 25. And the CPU 23 and the ROM 21 are connected with each other by the internal bus 24. The signal transmission between the mother board 40 and the gaming board 20 is executed by a PCI bus 25, and the power supply from the mother board 40 to the gaming board 20 is executed by the PCI bus 25. An after-mentioned verification program, a preliminary verification program, and a program for the CPU 23 to boot the preliminary verification program (not shown, boot code) are stored in the boot ROM 21.

The verification program is executed to check whether the gaming data being the object of the verification read process is falsified or not. And the verification program is written along the procedure for the verification of the gaming data. A game program (the first game program) is supplied to the slot machine 210 via the memory card 27. The verification program is the program used to verify the first game program by the CPU 32. The verification is a program used to check whether the game program is falsified or not. Therefore, it is also called falsification check program.

A preliminary verification program is used to verify whether the above verification program is falsified or not. The preliminary verification program is written along the procedure for the check of falsification of the verification program. In other words, verification program is used to verify the game program, and preliminary verification program is used to verify the verification program. The preliminary verification program is executed by the CPU 23.

The card slot 22*a* is connected to the mother board 40 by an IDE bus 26*a*. The card slot 22*a* is connected to the memory card 27 in a state in which the stored game program is in a readable state. The card slot 22*a* is a slot (mechanical connection) to which the memory card may be inserted.

The card slot 22*b* is connected to the mother board 40 by an IDE bus 26*b*. The card slot 22*a* is connected to the GAL 28 in a state in which the stored payout rate setting data is in a readable state. The card slot 22*b* is a slot (mechanical connection) to which the GAL 28 may be inserted.

The mother board 40 is constructed from general mother board (printed board which mounts basic components of a personal computer), and includes a main CPU 32(the first and the second gaming progress control means), a ROM 34, a RAM 33, an I/O port 39, a random number generating circuit 35, a sampling circuit 36, a clock pulse generation circuit 37, a frequency divider 38. And the above PCI bus 25 and IDE bus 26*a*, 26*b* are connected to the I/O port 39.

The main CPU 32 is executed based on the imported game programs. The input and output of the signals to the other elements are executed by the main CPU 32 via the I/O port 39, the performance control of the entirety slot machine 210 is also executed by the main CPU 32.

The data and the programs to boot the main CPU 32 are stored in the RAM 33. And also the verification program read through the gaming board 20 and at least the game program (the first game program) 33*a* are stored in the RAM 33.

In the ROM 34, the programs including the BIOS executed by the main CPU 32 (the standard BIOS in the mother board 40) and the perpetual data are stored. When the BIOS is executed by the main CPU 32, the initial process for predetermined peripheral devices is executed, and the read process for the game program stored in the memory card 27 is started via the gaming board 20. Memory devices such as flash memories are used in the ROM 34, the memories in which the contents are rewritable or not rewritable may be used in the ROM 34.

The random number generating circuit 35 is run based on the instruction of the main CPU 32. And a predetermined range of random numbers is generated by the random number generating circuit 35. The sampling circuit 36 is run based on the instruction of the main CPU 32. An arbitrary random number is extracted from the random numbers generated in the random number generating circuit 35, and the extracted random number is input to the main CPU 32. The basic clock pulse to run the main CPU 32 is generated by the clock pulse generating circuit 37. And the signal in which the basic clock pulse is divided in a predetermined frequency is input to the main CPU 32 by the frequency divider 38.

The slot machine 210 includes a communication process unit 211 and a communication control unit 212. The communication process unit 211 is the game program reception means in the present invention, and is run based on the instruction of the main CPU 32. The connection and the disconnection of the circuit used to communicate with the game server 200 is controlled by the communication process unit 211. The communication process unit 211 is also run based on the instruction of the communication control unit 212, and executes the data transmission.

Furthermore, the slot machine 210 includes a touch panel 3*a*, a lamp driving circuit 59, a lamp 60, a LED driving circuit 61, a LED 62, a hopper driving circuit 63, a hopper 64, a payout completion signal circuit 65 and a coin detection portion 66. Also the slot machine 210 includes an image control circuit 71 and a sound control circuit 72.

The touch panel 3*a* is arranged to cover the screen of the main display 3. The position to which the player's fingers touched is detected by the touch panel 3*a*, the position signal corresponding to the detected position is input to the main CPU 32. Therefore, the player may execute the input operation by the touch operation of fingers through the touch panel 3*a*.

The signals to light the lamp 60 is output by the lamp driving circuit 59, and the lamp 60 is flashed during the progressing of the game. The effect of the game is executed by the flashing of the lamp 60. The flashing of the LED 62 is controlled by the LED driving circuit 61. The number of coins credited and the number of coins received are displayed by the LED 62.

The hopper 64 is driven by the hopper driving circuit 63 based on the control of the main CPU 32. And the payout of coins is executed by the hopper 64. Coins are paid out from the payout opening 13 to the coin receiving portion 14.

The number of coins paid out by the hopper 64 is calculated by the coin detection portion 66, and the data of the calculated number is notified to the payout completion signal circuit 65.

The data of the number of coins from coin detection portion 66 is input by the payout completion signal circuit 65. When the number of coins reaches a predetermined number, the signal to notify the completion of coins is input to the main CPU 32.

Image display on the main display 3 and the sub-display 4 is controlled by the image control circuit 71. Scrolling images of plural symbols, effect images of the game effects, and various images including the status images which are used to notify the game status to the players, are displayed on the main display 3 and the sub-display 4.

The image control circuit 71 is run based on the various control instruction from the main CPU 32. The images displayed on the main display 3 and the sub-display 4 (scrolling images, the images of the symbols stopped and displayed after the display of the scrolling images) are formed, and the formed images are displayed on the main display 3 and the sub-display 4.

Sound signals for outputting the sound from the speaker 12L and 12R are input to the speaker 12L and 12R by the sound control circuit 72. From the speaker 12L and 12R, for example, the sound to boost the game mood at an appropriate timing after the game is started, is output.

The winning combination determination table 92 shown in FIG. 5 is stored in the above RAM 33 of the mother board 40.

The winning combination determination table 92 is a table referred to when the determination of the winning combination and payout number are made by the main CPU 32. And the winning combination is determined by the symbols combination of the symbols stopped and displayed on the three symbol display area 3A, 3B and 3C of the main display 3, and the payout number is determined when the winning combination is satisfied. The winning combination determination table 92 includes a symbol data area 92*a*, a payout number area 92*b*, a winning combination area 92*c*, and each area 92*a*, 92*b* and 92*c* associating with each other is stored in the winning combination determination table 92.

The symbol combination which may be the winning combination in the slot machine 210 is defined in the table 92. When a symbol combination in the table 92 is satisfied, coins corresponding to the winning combination are paid out from the slot machine 210. For example, when the symbol combination is "bell", "bell" and "bell", the winning combination of "bell" is satisfied, and ten coins are paid out.

Here, when the symbol combination is "7", "7" and "7", the winning combination of "7" which is game trigger is satisfied, thirty coins are paid out, and the game is progressed to a bonus game mode.

(Performance Contents of the Slot Machine)

Figure 6:
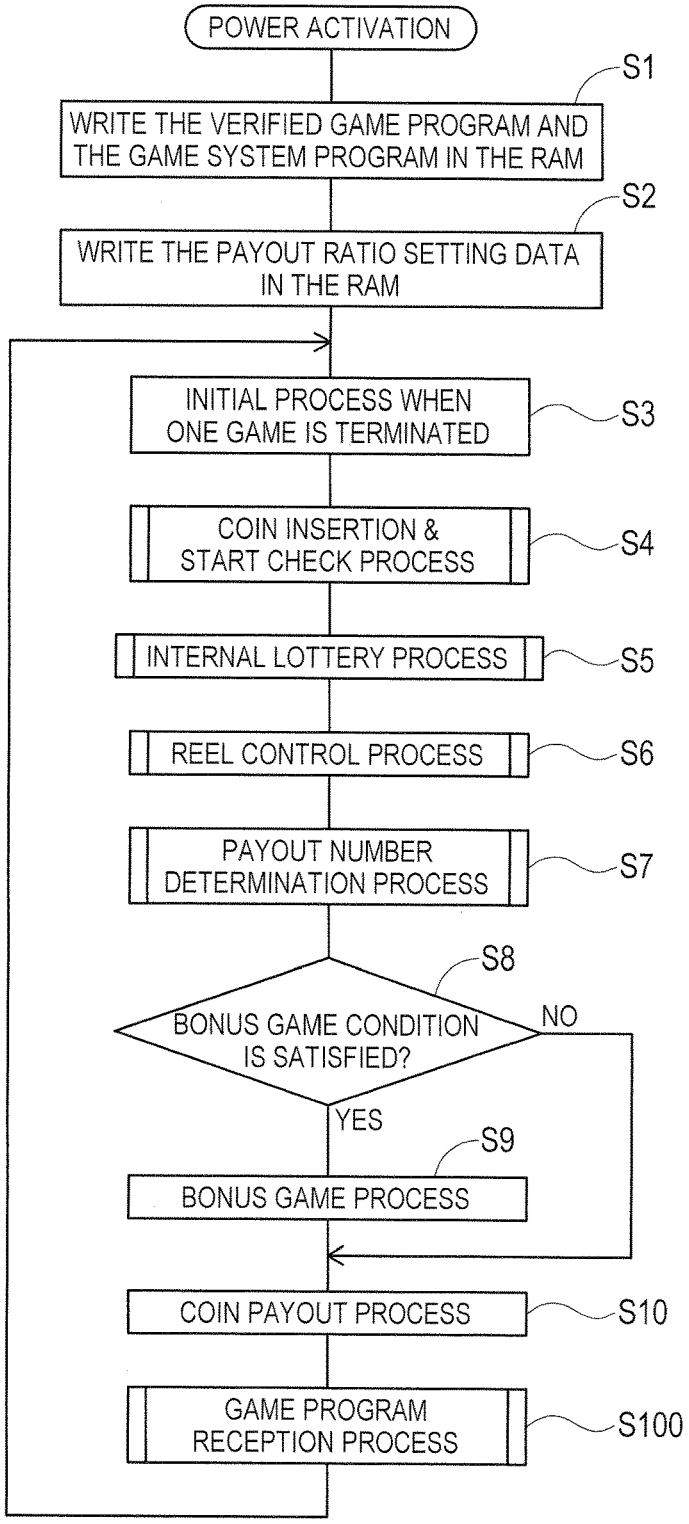
FIG. 6 is a flowchart showing a running procedure of a main control process according to the embodiment.

Next, the control process of the above gaming system 220 will be explained with reference to FIG. 6 to FIG. 11. FIG. 6 is a flowchart showing the running procedure of the main control process which is executed repeatedly after the system is started (main flowchart). In FIG. 6 to FIG. 11, step is abbreviated as "S".

(Running Procedure of the Main Control Process)

When the main control process is started with the booting of the system, the game is progressed to S3 after the execution of S1 and S2 by the main CPU 32 of the slot machine 210. And the game is progressed to a routine in which each step from the S3 to S10 and S100 is repeated and executed in sequence.

In S1, the BIOS stored in the ROM 34 is executed, and the verification program is read out from the boot ROM 21 and stored in the RAM 33, by the main CPU 32 of the slot machine 210. Furthermore, based on the verification program, the verification process of the game program stored in the memory card 27 is executed by the main CPU 32, and the game program is read out via the gaming board 20. The read-out game program is written in the RAM 33, and the game program is executed, the slot game (the first game) is progressed by the main CPU 32.

In S2, the payout rate setting data stored in the GAL 28 is read out by the main CPU 32 via the gaming board 20. And the read-out payout rate setting data is written in the RAM 33.

In S3, the initial process for starting a new slot game is executed by the main CPU 32. The initial process is a process to clear the data items set in a predetermined data area. And the initial process is executed each time one game of the slot game is terminated. Next, in S4 to S7, the coin insertion and the start check process, the internal lottery process, the reel control process and the payout number determination process are executed in sequence. Here, the slot game is executed in a base game mode.

Next, in S8, when the bonus game transfer condition (winning combination of "7" (game trigger) is elected) is satisfied during the base game mode, the game mode is transferred from the base game mode to the bonus game mode. And then procedure shifts to S9, and in S9, the bonus game process is executed by the main CPU 32. In the bonus game process, the free game is executed one or plural times by the main CPU 32. And after the execution of the bonus game process, procedure shifts to S10. When the bonus game transfer condition is not satisfied during the base game mode, the game is progressed directly to S10 without executing the S9.

In S10, the payout process of coins is executed, and coins are paid out directly or indirectly by the main CPU 32. When the cash-out switch 11 is "ON", the hopper 64 is driven and coins are paid out with a predetermined number to the coin receiving portion 14 by the main CPU 32. On the other hand, when the cash-out switch 11 is "OFF", a predetermined number of credits is added to the credit number counter by the main CPU 32, therefore, an indirect payout process is executed.

In S100, it is determined whether a predetermined gaming condition in the slot machine 210 is satisfied or not by the main CPU 32. When the predetermined gaming condition is satisfied, the second game program 206*a* is downloaded from the game server 200, and the second game program is executed.

(Coin Insertion and Start Check Process)

Figure 7:
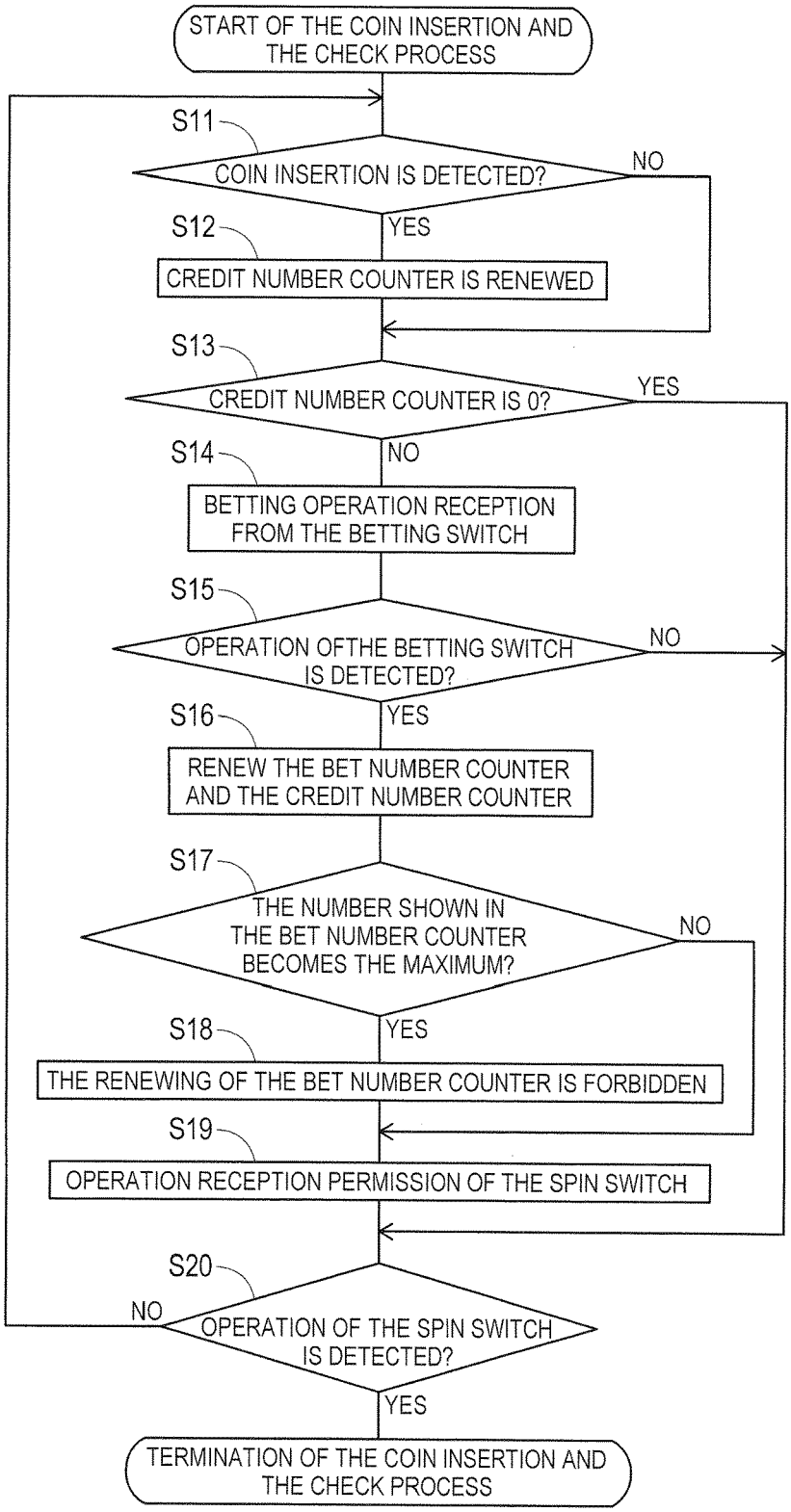
FIG. 7 is a flowchart showing a running procedure of a coin insertion and start-check process according to the embodiment.

The coin insertion and start check process in S4 is executed according to the flowchart shown in FIG. 7. When the coin insertion and start check process is started by the main CPU 32 in the slot machine 210, procedure shifts to S11. In S11, it is determined whether coins are inserted or not by the input of the signals from the coin insertion sensor 6*a*. When the coin insertion is detected by the main CPU 32, procedure proceeds to S12, and after the execution of S12, procedure proceeds to S13. However, when the coin insertion is not detected by the main CPU 32, procedure shifts to S13 without executing S12.

In S12, the credit number counter is renewed (the credits corresponding to the inserted coins are added). The credit number counter is used to show the remaining value of the credits which is constructed from coins inserted or coins to be paid out.

In S13, it is determined whether the credit number counter is "0" or not. When the credit number counter is "0", procedure shifts to S20. When the credit number counter is not "0", procedure proceeds to S14. In S14, the operation reception of the bet switch (1-bet switch 9 and the max-bet switch 10) is permitted.

In S15, it is determined whether the operation of the bet switch (betting operation) is detected or not by the CPU 32. When either betting operation is detected, procedure proceeds to S16, and when none of betting operation is detected, procedure shifts to S21. In S16, based on the bet switch in which the operation is detected, the bet number counter showing the bet number of coins and the credit number counter are renewed. In other words, the bet number shown in the bet number counter is increased, the credit number shown in the credit number counter is decreased.

In S17, it is determined whether the number shown in the bet number counter becomes the maximum or not. When the number shown in the bet number counter becomes the maximum, procedure proceeds to S18, a process in which renewing of the bet number counter is forbidden is executed, and then procedure proceeds to S19. When the number shown in the bet number counter is not the maximum, procedure shifts to S19 without executing S18. In S19, the operation reception of the spin switch 8 is permitted by the main CPU 32.

In S20, it is determined whether the operation of the spin switch 8 is detected or not by the main CPU 32. When the operation of the spin switch 8 is detected, the accumulation process of the jack pot amount is executed in S21. After the accumulation process in S21, the coin insertion and start check process is terminated. When the operation of the spin switch 8 is not detected, procedure returns to S11, and the above processes are repeated.

(Internal Lottery Process)

Figure 8:
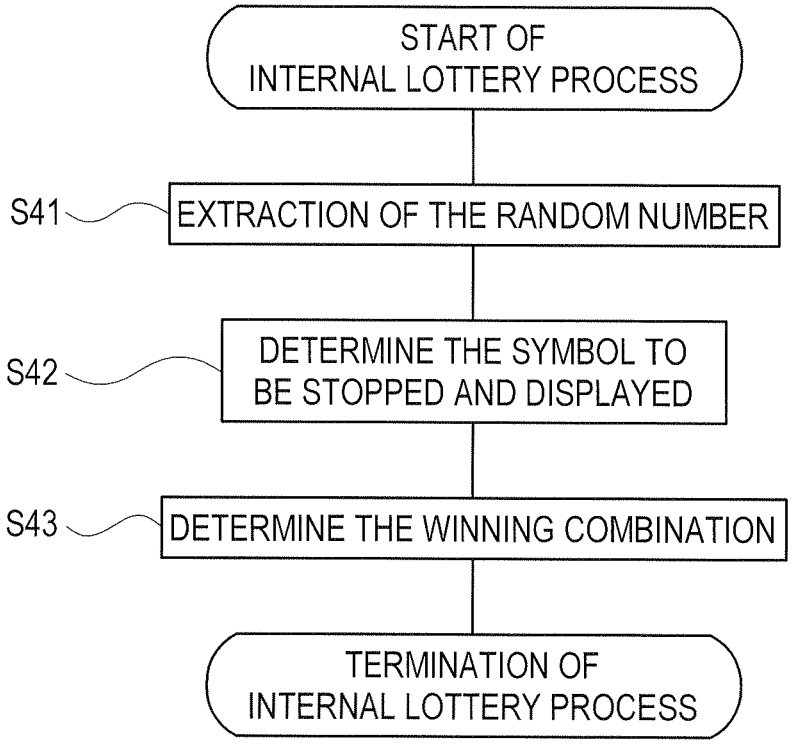
FIG. 8 is a flowchart showing a running procedure of an internal lottery process according to the embodiment.
Figure 9:
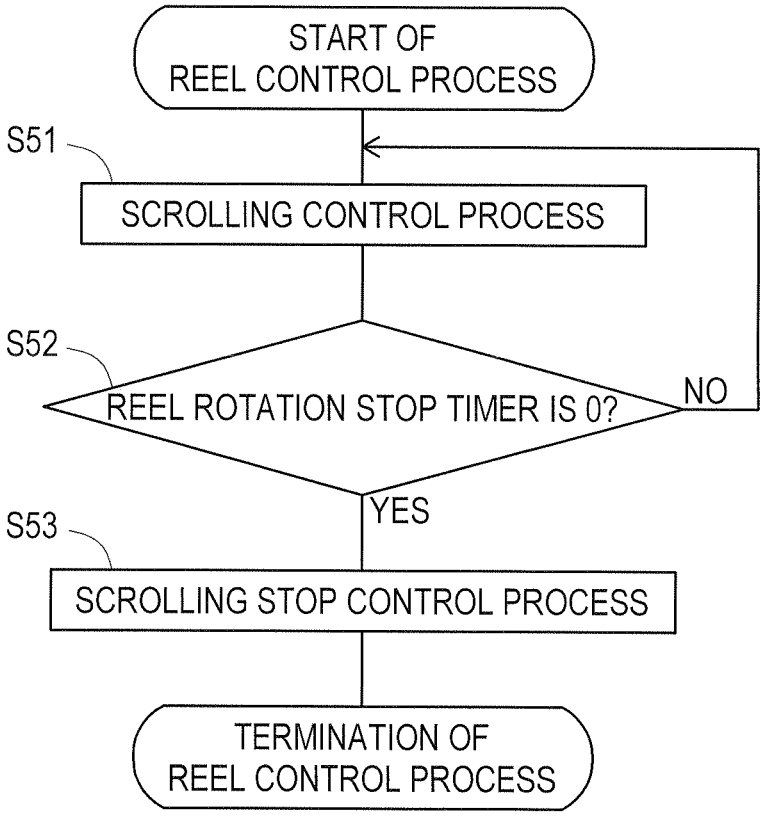
FIG. 9 is a flowchart showing a running procedure of a reel control process according to the embodiment.

When the coin insertion and start check process is terminated, procedure shifts to S5 shown in FIG. 8, the internal lottery process is executed. The internal lottery process is executed by the CPU 32 according to the flowchart shown in FIG. 8.

When the internal lottery process is started by the CPU 32, procedure shifts to S41. In S41, instructions are transmitted to the sampling circuit 36, and arbitrary random numbers are extracted from the random numbers generated by the random number generating circuit 35. In S42, based on the random numbers extracted in S41, the symbols which are stopped and displayed on each symbol display area 3A to 3C (symbols which are to be stopped and displayed) are determined. The determination is made by referring to the internal lottery table (omitted in the figures). Here, the extraction of the random number is executed three times to each symbol display area 3A to 3C. And the determination for the symbols which are to be stopped and displayed is also executed three times to each symbol display area 3A to 3C.

After the symbols which are to be stopped and displayed on each symbol display area 3A to 3C are determined, the symbol data of the determined symbols are stored in the symbol storing area which is saved in the RAM 33. The stopping and displaying of the symbols is executed by the main CPU 32, to each symbol display area 3A to 3C, based on the symbol data stored in the symbol storing area. Here, for example, the code number data based on the symbol arrangement on each reel (see FIG. 3) may be used as the symbol data.

In S43, the winning combination is determined by the main CPU 32, referring to the symbol data stored in the symbol storing area in the RAM 33 and the winning combination determination table 92 (see FIG. 5).

(Reel Control Process)

When the internal lottery process is terminated by the main CPU 32, procedure shifts to the S6 shown in FIG. 6. And in S6, the reel control process is executed by the main CPU 32, according to the flowchart shown in FIG. 9.

When the reel control process is started by the main CPU 32, procedure proceeds to S51, the scrolling control process is executed. Here, the scrolling images are displayed on each symbol display area 3A to 3C based on the instruction from the main CPU 32 to the image control circuit 71.

In S52, wait until the reel rotation stop timer which is set at a predetermined time becomes "0". When the reel rotation stop timer becomes "0", procedure proceeds to S53. In S53, the images in which the symbols are stopped and displayed on each symbol display area 3A to 3C are displayed, based on the instruction from the main CPU 32 to the image control circuit 71. After S53 is executed by the main CPU 32, the reel control process is terminated.

(Payout Number Determination Process)

When the reel control process is terminated, procedure shifts to S7 shown in FIG. 6, the payout number determination process is executed. Concretely, the payout number determination process is executed according to the flowchart shown in FIG. 10 by the main CPU 32.

Figure 10:
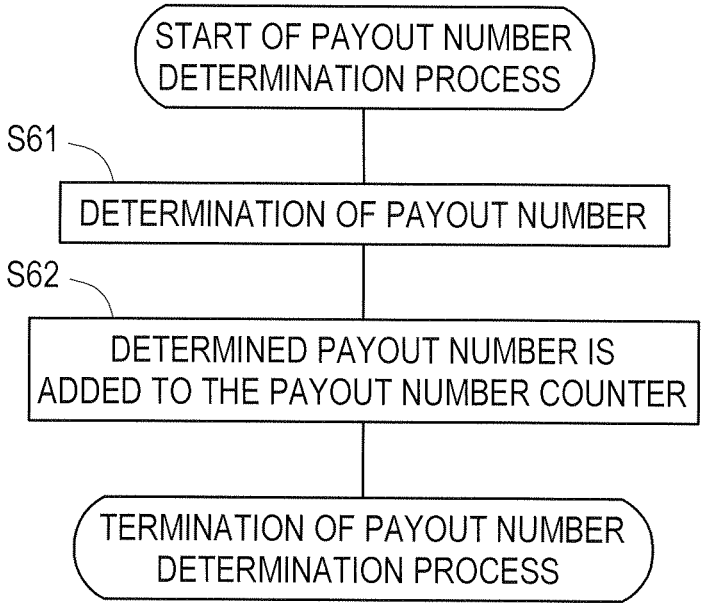
FIG. 10 is a flowchart showing a running procedure of a payout number determination process according to the embodiment.

As shown in FIG. 10, when the payout number determination process is started by the main CPU 32, procedure proceeds to S61, the payout number is determined. Concretely, the payout number corresponding to the winning combination determined in the internal lottery process is determined by referring to the winning combination determination table 92 (see FIG. 5). And then procedure proceeds to S62. Also when the symbol combination is not the winning combination included in the winning combination determination table 92, the symbol combination is treated as "outskirt", and the payout number is "0".

In other words, based on the combination of the symbol data (code number data) of the symbols which are to be stopped and displayed on each symbol display area 3A to 3C, the payout number and the winning combination are determined by referring to the table 92. When the symbol combination with the symbols which are to be stopped and displayed on each symbol display area 3A to 3C, is the same as the winning combination shown in the symbol data area 92*a* (for example, the symbol combination of "bell", "bell" and "bell"), from the payout number area 92*b* and the winning combination area 92*c* corresponding to the symbol data area 92*a*, the payout number and the winning combination are determined, by the main CPU 32.

In S62, the payout number of coins determined in S61 is added to the payout number counter stored in the RAM 33 by the main CPU 32.

When the payout number determination process is terminated, procedure shifts to S8 shown in FIG. 6. And in S8, it is determined whether the bonus game transfer condition is satisfied or not by the main CPU 32. When the bonus game transfer condition is satisfied, procedure proceeds to S9. In S9, the bonus game process is executed. And after S9, procedure proceeds to S10. However, when the bonus game transfer condition is not satisfied, procedure shifts to S10 without executing the bonus game process (S9).

In S10, the payout process of coins is executed by referring to the payout number counter. Coins corresponding to the counted number of the payout number counter is paid out in the payout process. Here, when the symbol combination of the stopped symbols is a winning combination, the payout number corresponding to the winning combination is added to the payout number counter. Also when the bonus game is executed, the payout number paid out in the bonus game is also added to the payout number counter.

(Game Program Reception Process)

When the coin payout process in S10 is terminated, procedure proceeds to S100, the game program reception process is executed by the main CPU 32. Concretely, based on the cooperation of the game server 200, the game program reception process is executed according to the sequence shown in FIG. 11, by the main CPU 32 of the slot machine 210.

Figure 11:
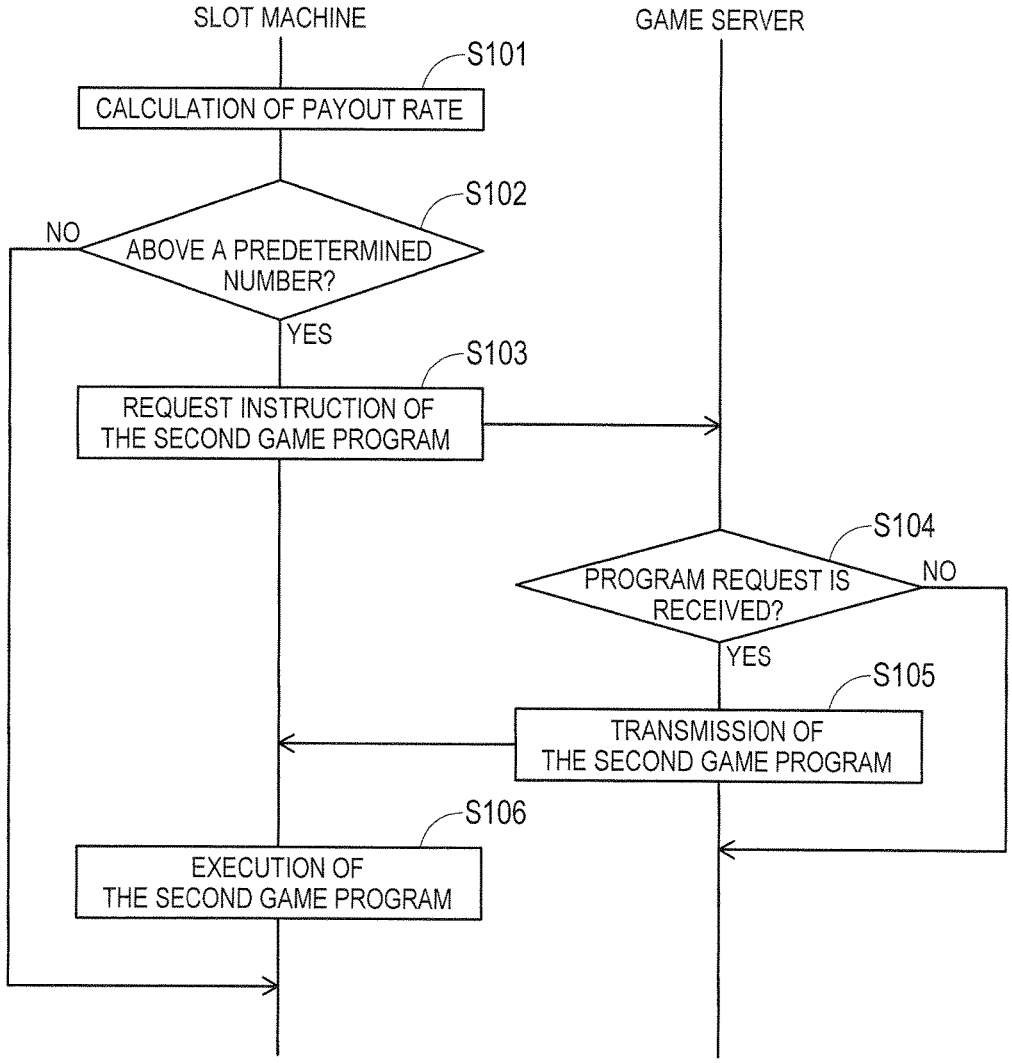
FIG. 11 is a sequence chart mainly showing a running procedure and data transmission between the slot machine and the game server during the game program reception process according to the embodiment.

As shown in FIG. 11, when the game program reception process is started, procedure proceeds to S101. In S101, the current payout rate in the slot machine 210 is calculated by the main CPU 32. When procedure proceeds to S102, it is determined whether the calculated payout rate is greater or equal a predetermined value (for example, 120%). When the calculated payout rate is under a predetermined value, the game program reception process is terminated.

When the calculated payout rate is greater or equal a predetermined value, procedure proceeds to S103. In S103 predetermined program request is transmitted to the game server 200 via the communication process unit 211.

In S104, it is determined whether the above program request is received from the slot machine 210 by the game server 200. When the program request is received, in S105, the second game program 206*a* is extracted from the memory device 206, and the second game program 206*a* is transmitted to the slot machine 210. On the other hand, when the program request is not received in S105, the process is terminated without transmitting the second game program 206*a* to the slot machine 210.

When the second game program 206*a* is received from the game server 200 via the communication process unit 211, the program 206*a* may be, for example, stored in the RAM 33 in which the first game program 33*a* is stored. In S106, the second game program stored in the RAM 33 is executed by the main CPU 32, and the second game corresponding to the second game program 206*a* is executed.

The second game, for example, is a slot game which is different from the above-mentioned slot game (the first game). Different symbols and different winning combination determination table are used in the second game. Also, under the condition that the second game is different from the first game, the second game is not limited to the slot game, it may also be the other game (for example, a trump game or a puzzle game).

As explained in detail above, in the gaming system 220, the slot game (the first game) corresponding to the first game program 33*a* in the RAM 33 is executed by the main CPU 32 of the slot machine 210. When the payout rate in the slot machine 210 is greater or equal to a predetermined value, during the progress of the slot game, the second game program is downloaded from the game server 200 via the communication process unit 211, by the slot machine 210. And the second game program is executed by the main CPU 32 (the second game progress control means) to progress the second game.

Since the second game is different from the first game, in additional to the first game, the second game is also provided to the player by the slot machine 210 of the gaming system 220. Therefore, when the player feels a little bored to the first game, a new game (the second game) may be provided to the player. In the gaming system 220, it is possible to continuously hold the player's interest, thereby, the entertainment aspect of the game may be enhanced.

Furthermore, when the first game is progressed via the communication process unit 211 by the slot machine 210, under a condition that a predetermined gaming condition is satisfied, the second game program may be downloaded from the game server 200. Therefore, based on the setting of the gaming condition to receive the second game program by the slot machine 210, various gaming status may be provided to the player.

As the gaming condition, in additional to being set related to the payout rate, following conditions may also be set as the gaming conditions.

a) whether or not the number of winning times in the bonus game is over a predetermined number Concretely, in the bonus game process, the free game is executed in plural times. And when the number of winning times in the bonus game exceeds a predetermined number, the second game program may be downloaded from the game server 200 by the slot machine 210.

b) whether or not a predetermined gaming time has passed

For example, when two hours of the gaming time have passed after the player starts the game, the second game program may be downloaded from the game server 200 automatically by the slot machine 210.

c) whether a predetermined winning combination is satisfied

For example, when the winning combination of "BAR", "BAR" and "BAR" is satisfied, the second game program may be downloaded from the game server 200 by the slot machine 210.

d) whether a predetermined number of gaming times is played

Concretely, when a player plays the base game over a predetermined number, the second game program may be downloaded from the game server 200 by the slot machine 210.

e) whether or not a predetermined timing comes

When a predetermined timing comes, the second game program may be downloaded from the game server 200 by the slot machine 210.

In above embodiment, after the downloading of the second game program, the state for executing the program right after the downloading is shown, for example, the game state may be set as executing the game after receiving the instruction input form the player. Also, plural game programs different from the first game program may be stored in the memory device 26 of the game server 200, the second game program may be selectively downloaded from the plural game programs. Also, the gaming machine is not limited to the slot machine, various gaming machines in which the first game and the second game may be executed, can be used as the gaming machines. Also, the second program may be downloaded to the hall server from the game server in advance, then the second game program may be downloaded from hall server by the slot machine.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A control method of a server that is connected to and communicates with a gaming machine for executing a first game and a second game, the server including a communication process unit, a memory device that stores a plurality of second game programs being different from a first game program, and a processor, the control method comprising:

by the processor, determining whether a program request for the second game is received via the communication process unit, the program request being transmitted by the gaming machine when a payout rate in the first game that the gaming machine executes according to the first game program is greater than or equal to a predetermined value;

selectively extracting a second game program from among the plurality of second game programs stored in the memory device in accordance with the program request from the gaming machine when receiving the program request; and transmitting the extracted second game program to the gaming machine via the communication process unit, to provide a gaming status according to the second game program which is extracted from among the plurality of second game programs being different from the first game program in accordance with the payout rate in the first game.

2. The control method according to claim 1, wherein the server does not transmit the second game program when the program request is not received.

3. A control method of a gaming system comprising a gaming machine for executing a first game and a second game and a server that is connected to and communicates with the gaming machine, the server including a communication process unit, a memory device that stores a plurality of second game programs being different from a first game program, and a processor, and the gaming machine including a gaming board for payout rate setting data, the control method comprising:

executing the first game and calculating a payout rate in the first game by referring to the payout rate setting data of the gaming board, by the gaming machine;

transmitting, by the gaming machine, a program request for the second game to the server when the payout rate in the first game is greater than or equal to a predetermined value;

determining, by the server, whether the program request is received via the communication process unit, the program request being transmitted by the gaming machine when the payout rate in the first game that the gaming machine executes according to the first game program is greater than or equal to a predetermined value;

selectively extracting, by the server, a second game program from among the plurality of second game programs stored in the memory device in accordance with the program request from the gaming machine when receiving the program request; and transmitting, by the server, the extracted second game program to the gaming machine via the communication process unit, to provide a gaming status according to the second game program which is extracted from among the plurality of second game programs being different from the first game program in accordance with the payout rate in the first game.

4. The control method according to claim 3, further comprising calculating, by the gaming machine, the payout rate in the first game by referring to the payout rate setting data when a payout process in the first game is terminated.

5. The control method according to claim 3, wherein the gaming machine further includes an input device that receives an indication input from a player, and wherein the second game program is executed after the input device receives the indication input from the player.

6. The control method according to claim 3, wherein the gaming machine further includes an input device that receives an indication input from a player, and wherein the gaming machine, when receiving the second game program from the server, executes the second game program is executed after receiving the indication input from the player.

7. The control method according to claim 3, wherein when the payout rate in the first game is greater than or equal to the predetermined value, the gaming machine receives the second game program from the server while being progressing the first game, and executes the second game program to progress the second game.

8. The control method according to claim 3, wherein the second game is executed independently from a result of a bonus game.

* * * * *